US006879092B2

(12) United States Patent
Tho

(10) Patent No.: US 6,879,092 B2
(45) Date of Patent: Apr. 12, 2005

(54) STRUCTURE OF SLOT FEATURE FOR SHADOW MASK

(75) Inventor: Gi Hoon Tho, Gyaengeangbuk-Do (KR)

(73) Assignee: LG. Philips Displays Korea Co., Ltd., Kyeonsangbuk-do (KR)

( * ) Notice: Subject to any disclaimer, the term of this patent is extended or adjusted under 35 U.S.C. 154(b) by 0 days.

(21) Appl. No.: 10/241,527

(22) Filed: Sep. 12, 2002

(65) Prior Publication Data

US 2003/0222563 A1 Dec. 4, 2003

(30) Foreign Application Priority Data

May 29, 2002 (KR) ..... 2002-29977

(51) Int. Cl.[7] ..... H01J 29/80

(52) U.S. Cl. ..... 313/403; 313/402; 313/407; 313/408

(58) Field of Search ..... 313/407, 408, 313/402, 403

(56) References Cited

U.S. PATENT DOCUMENTS 5,280,215 A 1/1994 Ohtake et al.
5,411,822 A 5/1995 Ohtake et al.
6,313,574 B1 * 11/2001 Banno et al. ..... 313/402
6,356,010 B1 * 3/2002 Nakamura ..... 313/402

FOREIGN PATENT DOCUMENTS

JP 02-086027 A 3/1990

* cited by examiner

*Primary Examiner*—Joseph Williams
*Assistant Examiner*—Matt Hodges
(74) *Attorney, Agent, or Firm*—Birch, Stewart, Kolasch & Birch, LLP

(57) ABSTRACT

A structure of a slot feature for a shadow mask in which, on the assumption that the width at the point of ½ in a vertical direction in the feature of slots of the shadow mask is 'Sw', horizontal distances from a virtual vertical line passing an apex of a concave portion of a slot at a marginal portion to a protrusion portion formed at both upper and lower sides on the basis of the width Sw line are 'M' and 'N', and angles inclined in the direction of the protrusion portion from the virtual straight line passing the apex of the curved protrusion portion formed at the opposite side of the concave portion are 'P' and 'Q', there are at least one and more mask slot satisfying a formula of M>0, N>0, P>0°, Q>0°. The shape of electron beams by positions on the screen are identical to each other, and the shape of electron beam at the left and right sides of marginal portion can be maintained in a straight line in the vertical direction. Accordingly, a purity margin of the electron beam can be increased and brightness characteristics can be improved, and thus, a quality of color reproduction can be heightened.

10 Claims, 8 Drawing Sheets

θ1 > θ2

STRUCTURE OF SLOT FEATURE FOR SHADOW MASK

This application claims priority of Korean patent application no. 29977/2002, filed May 29, 2002, the entire contents of which are hereby incorporated by reference.

BACKGROUND OF THE INVENTION

1. Field of the Invention

The present invention relates to a shadow mask of a cathode ray tube (CRT), and more particularly, to a structure of a slot feature of a shadow mask that is capable of improving characteristics of purity margin and brightness by projecting electron beams of certain shape on a screen formed at a rear side of a panel.

2. Description of the Background Art

In general, the shadow mask is installed inside a Braun tube used for a TV or a monitor set and performs a color sorting to mount electron beams generated from an electron gun on a desired fluorescent material surface of the screen.

As shown in FIG. 1, the CRT includes a fluorescent face 4, to which a front glass called panel 1 and a rear glass called a funnel 2 are coupled, being emitted inside the panel 1; an electron gun 10, the source of the electron beams 6 for emitting the fluorescent face; a shadow mask 3 for sorting a color so as to emit a certain fluorescent face, and a frame 7 for supporting the shadow mask.

A spring 8 for rendering a frame assembly to be coupled to the panel 1 and an inner shield 9 for reducing an influence of an external terrestrial magnetism during the operation of the CRT are coupled to the frame, and the panel and the funnel are sealed with a high vacuum.

The operational principles of the CRT will now be described.

The electron beam 6 is landed on the fluorescent face 4 formed inside the panel 1 by an anode voltage applied to the CRT from the electron gun 10 inserted in a neck portion (with no reference numeral). At this time, before the electron beam 6 reaches the fluorescent face 4, it is deflected up, down, left and right by a deflection yoke 5 to display an image.

Pole magnet 11 corrects the proceeding trajectory so that the electron beam 6 can accurately hit the fluorescent face 4, thereby preventing deterioration of a color purity.

A reinforcing band 12 is coupled at an outer circumferential surface of a junction portion between the panel 1 and the funnel 2 to reinforce the junction.

As shown in FIG. 2, the fluorescent face 4 inside the panel 1, a graphite band 4*a*, and red, green and blue fluorescent material 4*b* are coated in a stripe form.

The shadow mask 3 has a dome shape, maintaining a certain space from the inside of the panel 1, including, as shown in FIG. 3, an effective surface portion 3*b* with a plurality of slots in a stripe form formed at the central portion, a mask skirt portion (not shown) almost vertically bent from the marginal portion 3*c* at the outermost portion of the marginal portion 3*c*.

The shadow mask 3 typically has a thickness of about 0.1~0.3 mm.

The plurality of slots 3*a*, holes through which the electron beam 6 passes, are formed with a certain arrangement on the effective surface portion 3*b* of the shadow mask 3.

With reference to FIG. 4, the red, green and blue electron beams 6 are focussed on the fluorescent material face 4 through the slots 3*a* formed at one side of the shadow mask 3.

Thus, when the electron beams 6 hit the fluorescent material face 4 of the panel 1 after passing the shadow mask 3, the electron beams 6 formed on the fluorescent material face 4 have a similar shape as the mask slot 3*a*.

That is, the shape of the electron beam 6 before passing the slots 3*a* of the shadow mask 3 is similar to a circle in view of its section, and the section of the shape of the electron beam 6 focussed on the fluorescent material face 4 is formed according to the shape of the slot 3*a* (refer to FIGS. 6B and 6D).

As shown in FIG. 5, in the conventional CRT, the angle (θ1) at which the deflected electron beam 6 is made incident on the shadow mask 3 is close to a right angle, while an angle (θ2) at which the deflected beam is made incident on the mask becomes small in a flat type CRT.

Accordingly, the shape of the electron beam 6 formed on the panel 1 is different from the shape of the slot 3*a* formed at one side of the shadow mask 3 depending on the deflected angle, the distance between the shdow mask 3 and the inner side of the panel 1 and the distance between the deflection yoke 5 and the shadow mask 3, and the left and right shapes of the electron beam 6 are not identical to each other.

As shown FIGS. 6A through 6D, such a phenomenon does not take place on the entire screen, and generally, the longer it is distanced from the center, the more serious the phenomenon is.

FIGS. 6A and 6C show a shape of the slot 3*a* uniformly formed at the central portion and the marginal portion of the shadow mask 3. FIG. 6B shows a shape of the electron beam 6 focussed at the central portion of the fluorescent face 4 according to the slot feature of 6A, and FIG. 6D shows a shape of the electron beam 6 focussed at the marginal portion of the fluorescent material face 4 according to the slot feature of 6C As for the color CRT, the outer surface of the panel is advanced to a flat surface from the past curved surface in order to prevent degradation and visual fatigue, and as the color CRT is adapted for various uses, there is a tendency for advancing to a high quality with a fine pitch that can adopt frequencies of various modes.

Accordingly, the tendency is for the inner curvature of the panel 1 to become flat compared to a general CRT, and the curvature of the shadow mask 3 also becomes flat.

As the curvature becomes flat, the incident angle of the electron beam 6 is gradually changed to an acute angle as it goes toward the marginal portion of the screen. Accordingly, after the electron beam 6 passes the slot 3*a* of the shadow mask 3, when the electron beam 6 is projected on the inside of the panel 1, the shape of the electron beam 6 is distorted.

In addition, in a fabrication process such as a series of operations such as a deflection yoke engagement and a landing correction, due to the distortion in the shape of the electron beam 6, there occurs a difference between a landing level determined by operators' naked eyes and an actual landing value, resulting in that a process time is lengthened due to the increase in the corresponding working time and an operation level is also degraded (refer to FIG. 7).

In FIG. 7, reference numeral 6*a* shows a shape of the electron beam 6 which has passed the shadow mask 3, and reference numeral 20 shows a shape after a portion of the electron beam 6 is absorbed into the graphite band 4*a* constituting the fluorescent material face 4.

In this case, since the shape of the left and right transmitted electron beam 6*a* is shown that the outer side has a circular arc for the central portion, operators may misjudge its actual landing value during a fabrication process.

In order to solve the problems, Japanese patent publication No. 2-86027 solves the problem in such a manner that a cut-out portion is additionally formed toward the marginal portion of the shadow mask with respect to the feature of each slot. But a problem arises in that the electron beam irradiated on the screen after passing the central portion of the shadow mask fails to have a perfectly straight line.

SUMMARY OF THE INVENTION

Therefore, an object of the present invention is to provide a structure of a slot feature for a shadow mask that is capable of improving quality characteristics of a CRT such as a margin and brightness and improving difficulties in a fabrication process by optimizing a slot feature according to an incident angle according to a trajectory of electron beams and optimizing a shape of a beam projected on a screen.

To achieve these and other advantages in accordance with the purpose of the present invention, as embodied and broadly described herein, there is provided a structure of a slot feature for a shadow mask in which, on the assumption that the width at the point of ½ in a vertical direction in the feature of slots of the shadow mask is 'Sw', horizontal distances from a virtual vertical line passing an apex of a concave portion of a slot at a marginal portion to a protrusion portion formed at both upper and lower sides on the basis of the width Sw line are 'M' and 'N', and angles inclined in the direction of the protrusion portion from the virtual straight line passing the apex of the curved protrusion portion formed at the opposite side of the concave portion are 'P' and 'Q', there are at least one and more mask slot satisfying a formula of M>0, N>0, P>0°, Q>0°.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 8A:
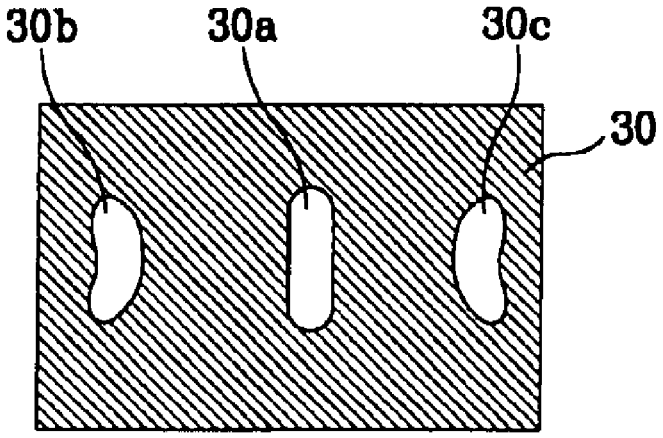
FIG. 8A is a schematic view showing a shadow mask adopting a structure of slot feature for a shadow mask in accordance with the present invention.
Figure 8B:
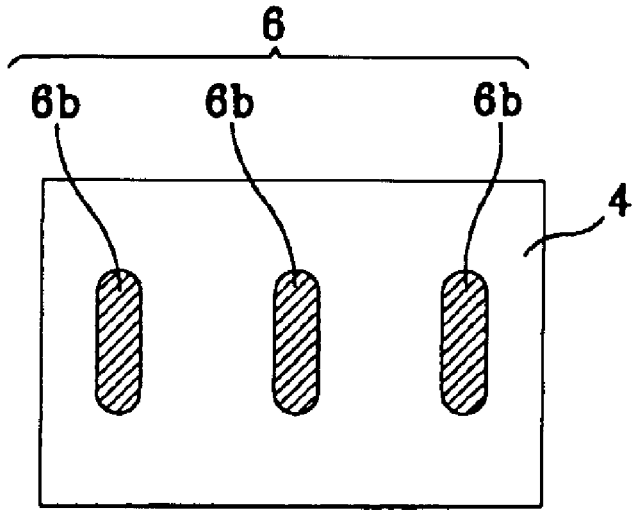
FIG. 8B is a schematic view showing a shape of electron beam after passing slots of FIG. 8A.

FIG. 8A is a schematic view showing a shadow mask adopting a structure of a slot feature for a shadow mask in accordance with the present invention; and FIG. 8B is a schematic view showing a shape of electron beam after passing slots of FIG. 8A.

The shadow mask 30 includes a central slot 30*a* formed at its central portion, and a plurality of slots 30*b* and 30*c* formed at a marginal portion distanced from the central portion in consideration of the fact that an electron beam 6 is distorted when it passes the shadow mask 30.

In general, the shape of the electron beam 6 is considerably distorted in its central portion with the incident direction as it goes toward the marginal portion.

Figure 1:
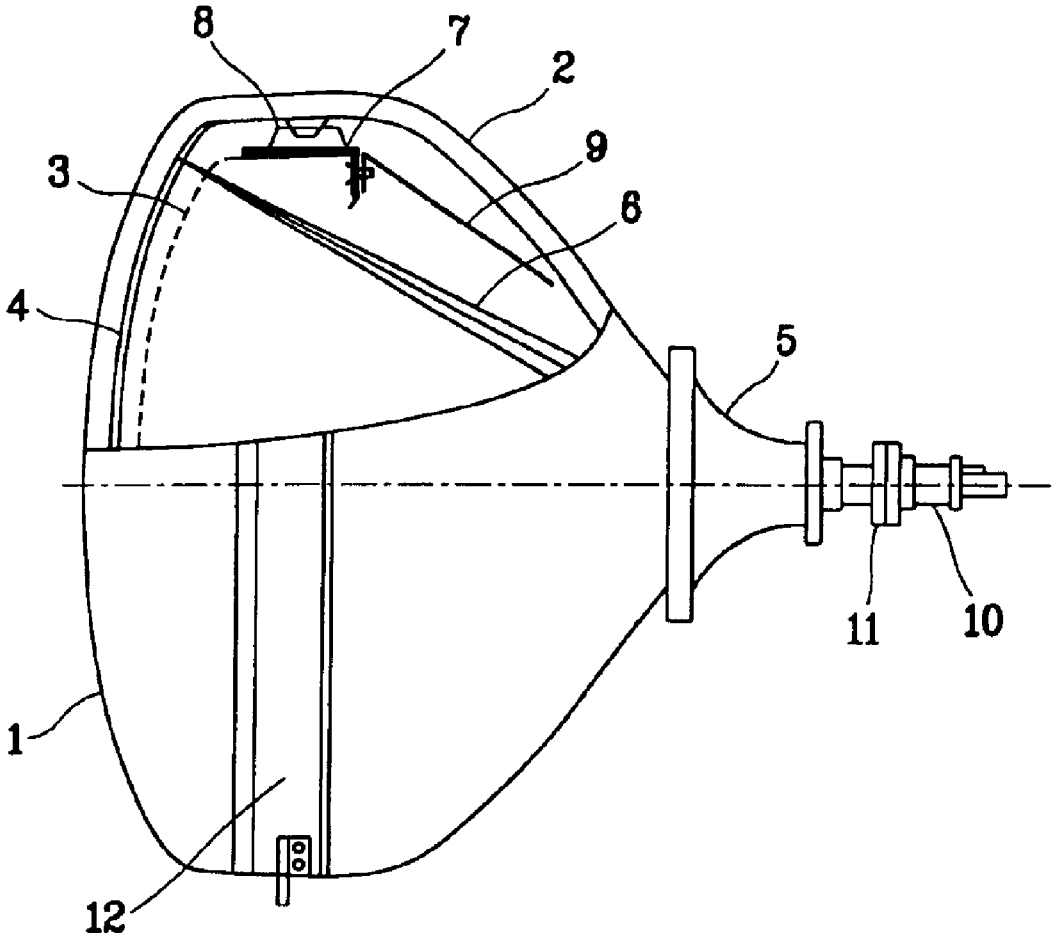
FIG. 1 CONVENTIONAL ART
FIG. 1 is a partial sectional view showing a general cathode ray tube.
Figure 2:
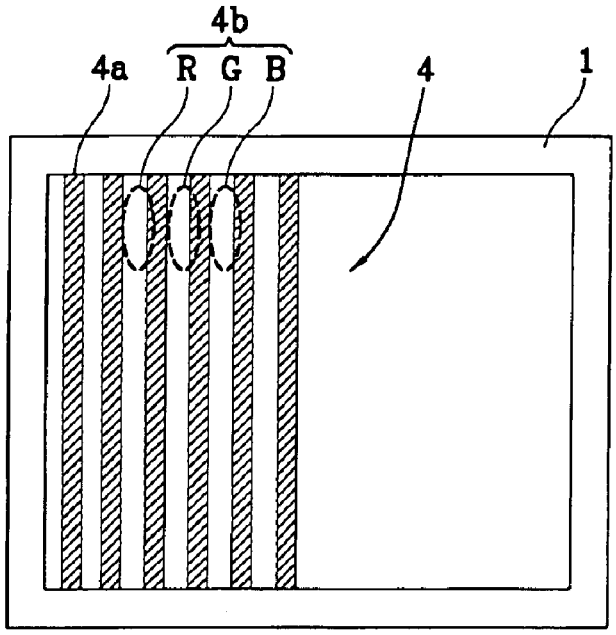
FIG. 2 CONVENTIONAL ART
FIG. 2 is a schematic plan view showing a fluorescent material face and a graphite band coated on the inner surface of a panel.
Figure 3:
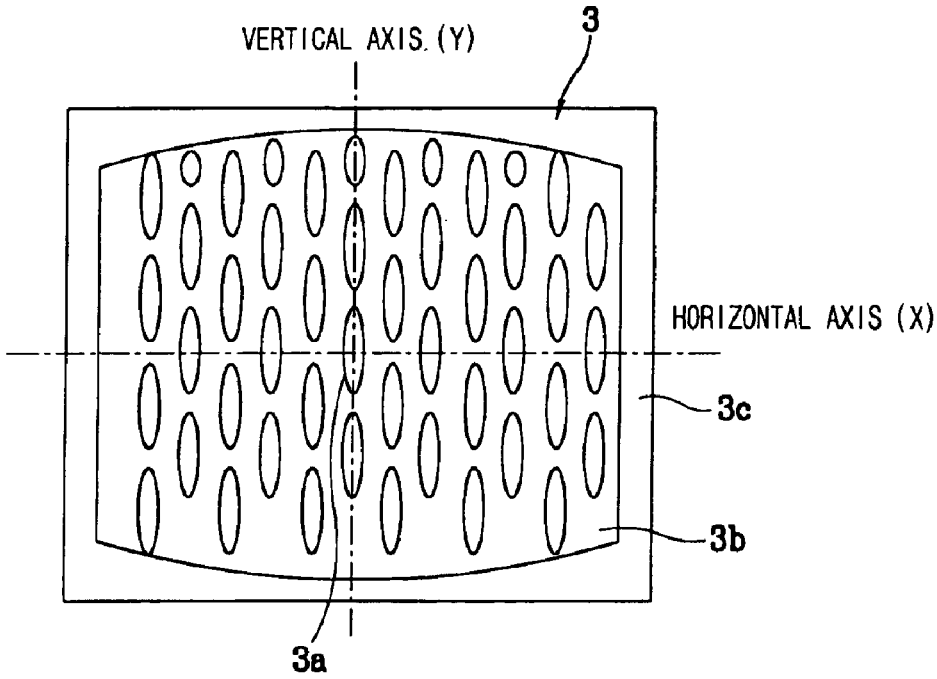
FIG. 3 CONVENTIONAL ART
FIG. 3 is a schematic plan view showing a shadow mask of a general CRT.
Figure 4:
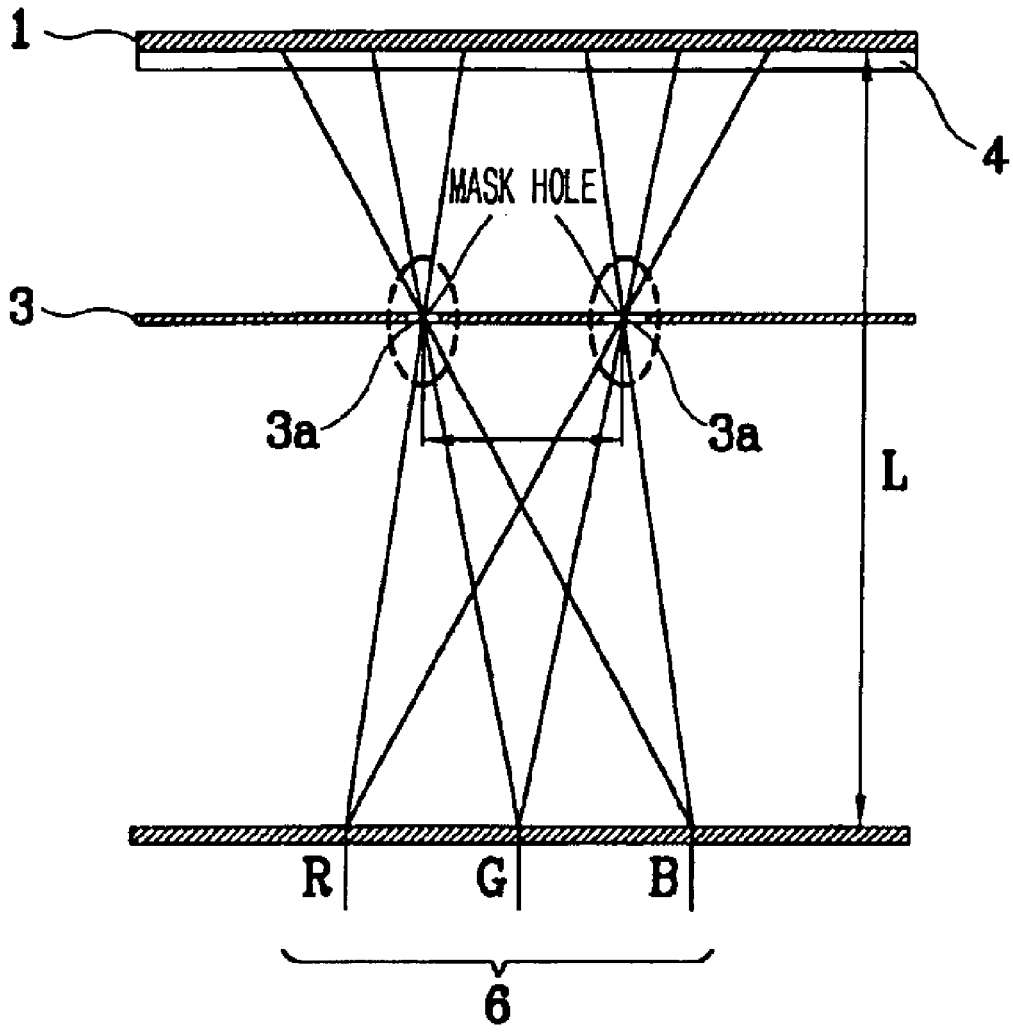
FIG. 4 CONVENTIONAL ART
FIG. 4 is a schematic view showing a movement of an electron beam deflected inside the general CRT.
Figure 5:
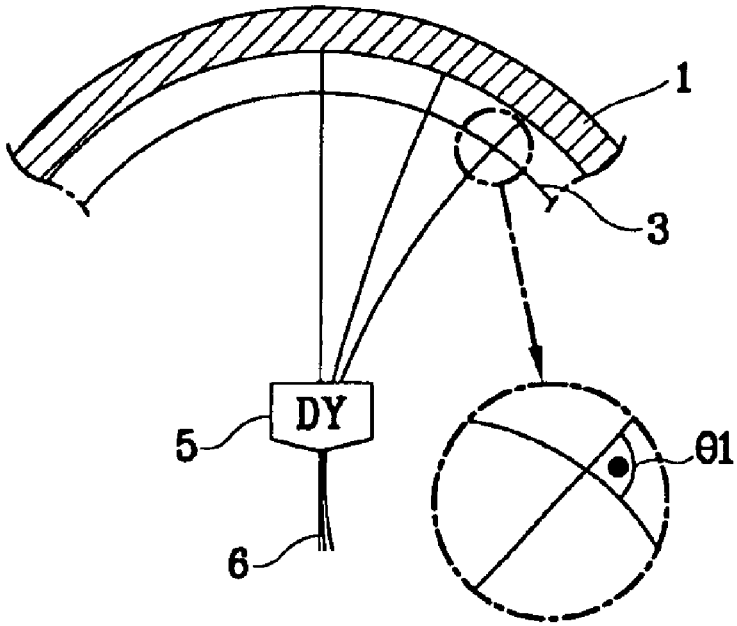
FIG. 5 CONVENTIONAL ART
FIG. 5 is a schematic view showing that the angles of the incident electron beams differs depending on the thickness of the panel inside the CRT.
Figure 5:
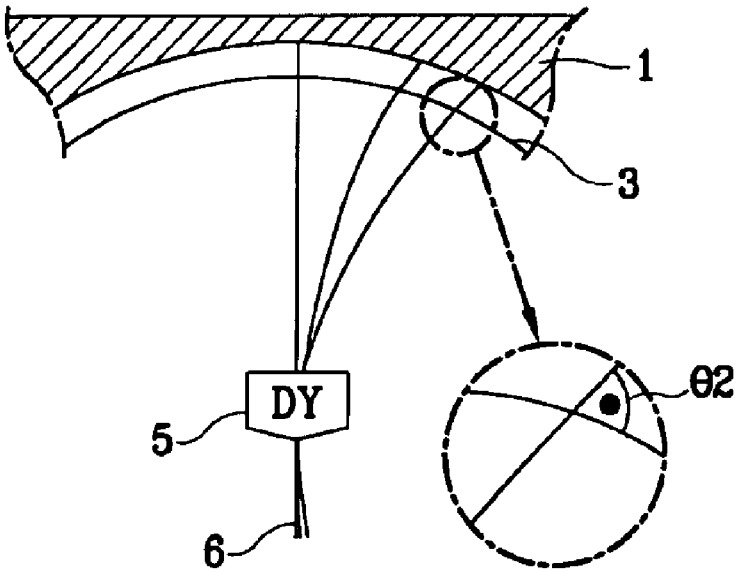
FIG. 5 CONVENTIONAL ART
Figure 6A:
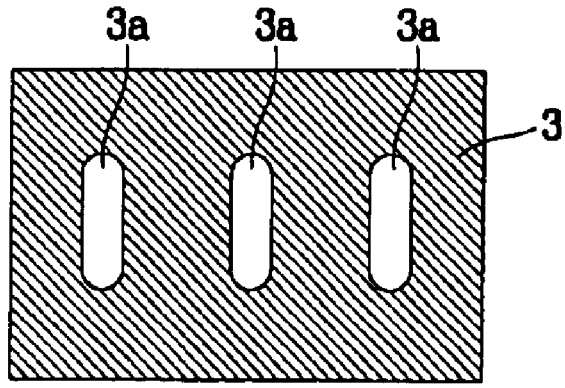
FIG. 6A CONVENTIONAL ART
FIG. 6A is a schematic view showing slots formed at a central portion of the shadow mask in accordance with a conventional art.
Figure 6B:
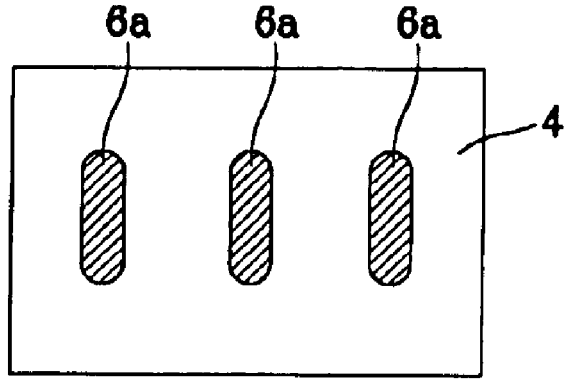
FIG. 6B CONVENTIONAL ART
FIG. 6B is a schematic view sowing a shapeof an electron beam appearing on a fluorescent material face after passing slots of FIG. 6A.
Figure 6C:
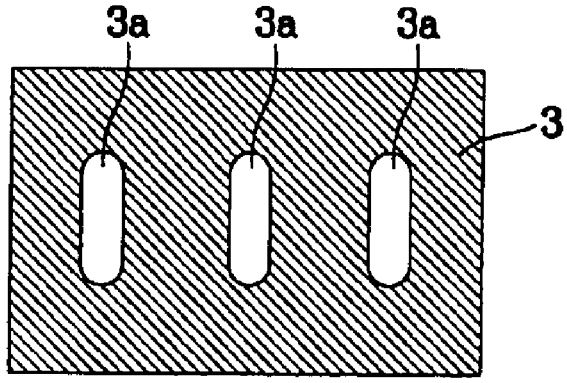
FIG. 6C CONVENTIONAL ART
FIG. 6C is a schematic view showing slots formed at a marginal portion of the shadow mask in accordance with the conventional art.
Figure 6D:
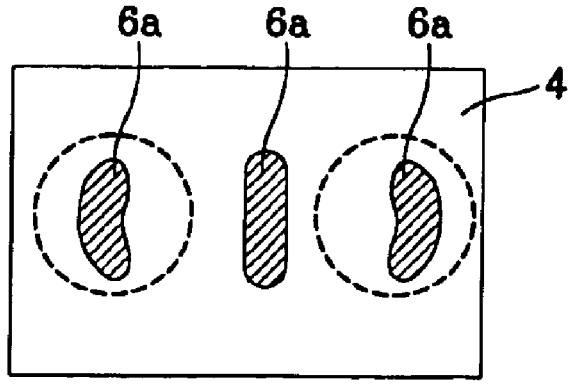
FIG. 6D CONVENTIONAL ART
FIG. 6D is a schematic view showing a shape of electron beams appearing on the fluorescent material face after passing the slots of FIG. 6C.
Figure 7:
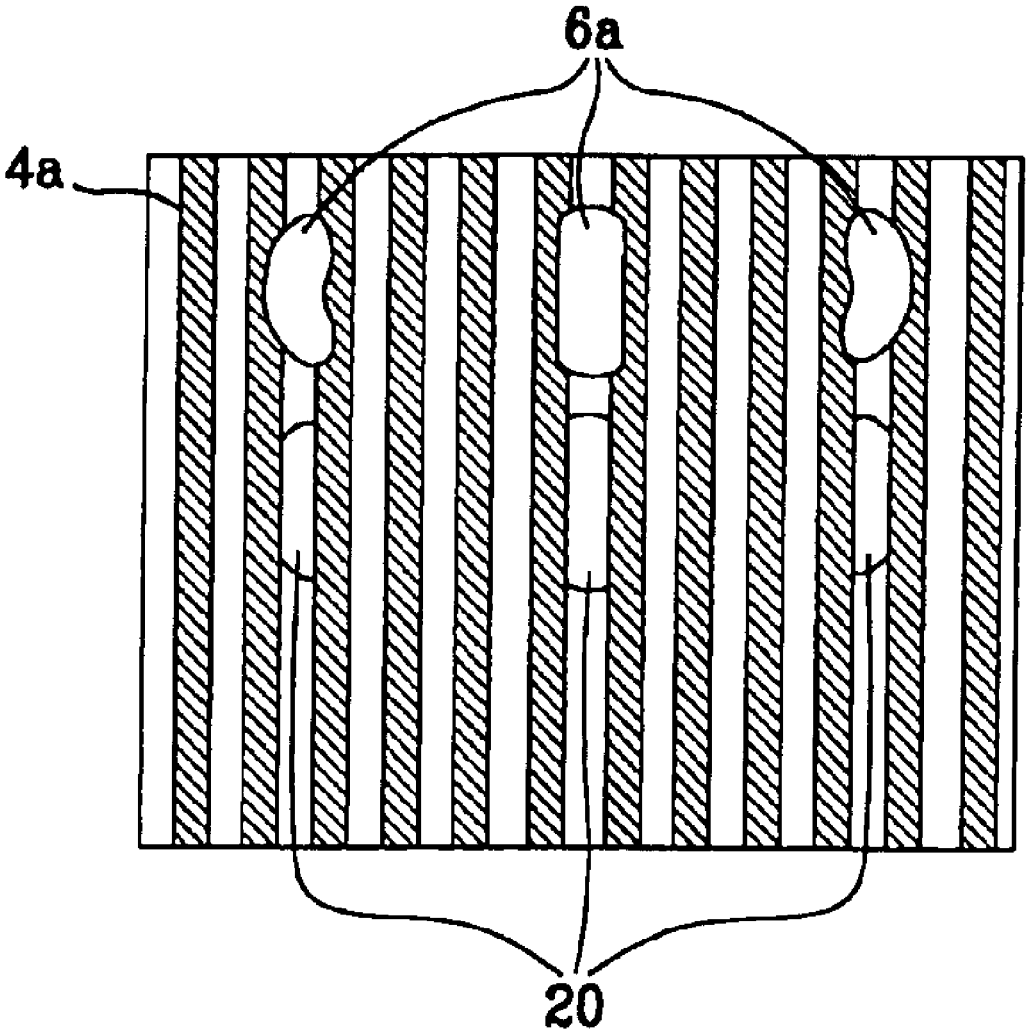
FIG. 7 CONVENTIONAL ART
FIG. 7 is a schematic view showing a shape of electron beams transmitted and formed on the fluorescent material face and a shape of electron beams appearing on the actual screen.

That is, in the present invention, unlike the FIGS. 6A and 6C in the conventional art, the slots 30*a*, 30*b* and 30*c* are formed with different forms at the central portion and the marginal portion, so that the left and right shape of the electron beam 6*b* focussed on the fluorescent material face 4 is formed straight lines regardless of the incident angle of the electron beam.

Away from the conventional concept focussing on the slot feature of the shadow mask 30, the present invention focuses on the shape of the electron beam focussed on the screen to implement an ideal shadow mask slot form.

The slots 30*b* and 30*c* at the marginal portion will now be described in detail.

Figure 9:
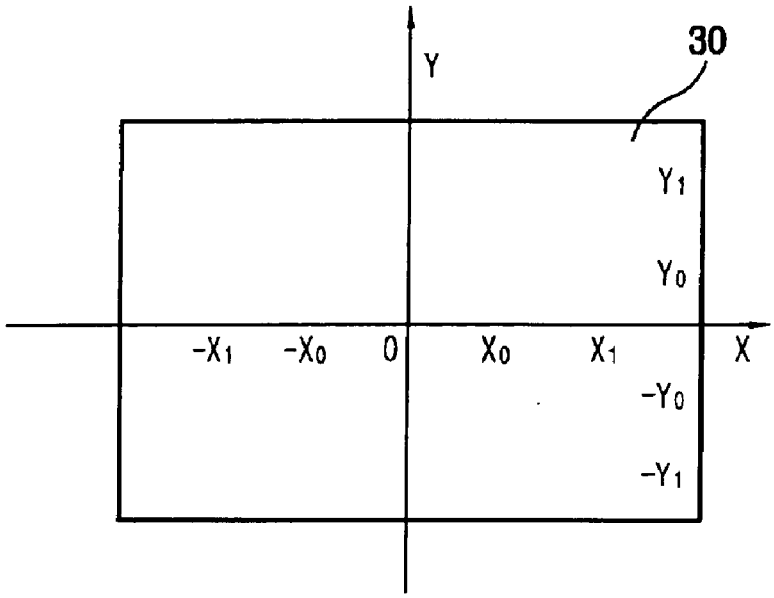
FIG. 9 is a schematic view showing set coordinates of the shadow mask adopting the structure of a slot feature for the shadow mask in accordance with the present invention.
Figure 10:
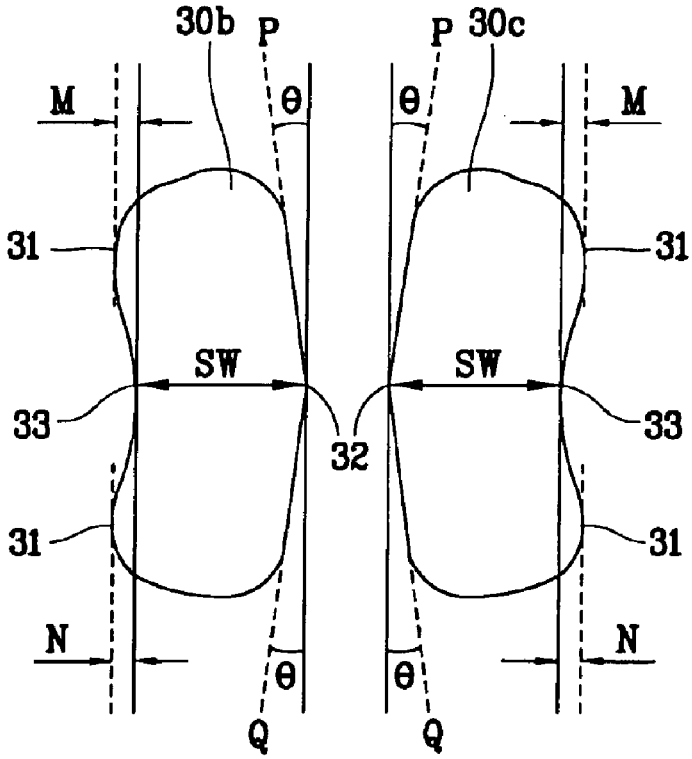
FIG. 10 is a schematic view showing enlarged slots at the marginal portion.

FIG. 9 is a schematic view showing set coordinates of the shadow mask adopting the structure of a slot feature for the shadow mask in accordance with the present invention, and FIG. 10 is a schematic view showing enlarged slots at the marginal portion.

As shown in FIG. 10, on the assumption that the width at the point of ½ in a vertical direction in the feature of slots 30*b* and 30*c* of the shadow mask 30 is 'Sw', horizontal distances from a virtual vertical line passing an apex of a concave portion 33 of a slot at a marginal portion to a protrusion portion formed at both upper and lower sides on the basis of the width Sw line are 'M' and 'N', and angles inclined in the direction of the protrusion portion 31 from the virtual straight line passing the apex of the curved protrusion portion 32 formed at the opposite side of the concave portion 33 are 'P' and 'Q'.

At this time, the values of 'M', 'N', 'P' and 'Q' defining the feature of the slots 30*b* and 30*c* at the marginal portion satisfy the following formula:

$$M>0,\ N>0,\ P>0^\circ,\ Q>0^\circ \quad (1)$$

As shown in FIG. 10, when coordinates where the slots 30*a*, 30*b* and 30*c* are positioned are expressed as an X (horizontal)—Y (vertical) coordinate system, the values of 'M', 'N', 'P' and 'Q' satisfy the following formulas:

$$\text{provided that } |X_0|<|X_1|,\ |M_0|\leqq|M_1|,\ |N_0|\leqq|N_1| \text{ and } |P_0|\leqq|P_1|,\ |Q_0|\leqq|Q_1|. \quad (2)$$

$$\text{provided that } |Y_0|<|Y_1|,\ |M_0|\geqq|M_1|,\ |N_0|\geqq|N_1| \text{ and } |P_0|\geqq|P_1|,\ |Q_0|\geqq|Q_1|. \quad (3)$$

Since the incident angle becomes small as it goes to the marginal portion, the values of 'M', 'N', 'P' and 'Q' are preferred to have gradation in its size.

In most cases, the width of the slot of the shadow mask is designed such that the marginal portion is greater than the central portion.

The width of the slot of the shadow mask is usually 0.15~0.25 mm.

The electron beam 6 is distorted on the shadow mask 30 with the size of more or less 10% of size of the normal mask slot. Thus, in consideration of the slot size of the shadow mask, the values of 'M' and 'N' preferably do not exceed 0.033 mm.

That is, if the slot size exceeds 0.033 mm, there is a high possibility that the central portion would be rather concave, not that the outer side of the shape of beam is straight.

The angles of 'P' and 'Q' are preferably within 45° in the same context.

Since the shadow mask 30 is in the tendency of being flattened and large-scaled in its size, the above relational expression can be more preferable when the length of a diagonal line of the shadow mask 30 is more than 490 mm.

The slots 30*b* and 30*c* at the marginal portion are preferred to have a mutually symmetrical form against the center of the shadow mask 30.

The symmetry is preferred to be formed in the long side axis direction against the center of the shadow mask.

As so far described, the structure of slot feature for a shadow mask of the present invention has many advantages.

That is, by limiting a slot feature of the shadow mask, the shape of the electron beam focussed on the screen is optimized, so that the shape of the electron beam on the screen is prevented from distortion and thus, an ideal shape of beam can be implemented.

In addition, the shape of electron beams by positions on the screen are identical to each other, and the shape of electron beam at the left and right sides of marginal portion can be maintained in a straight line in the vertical direction. Accordingly, a purity margin of the electron beam can be increased and brightness characteristics can be improved, and thus, a quality of color reproduction can be heightened.

Moreover, the workability in view of a fabrication process can be improved and the process time and quality can be simultaneously heightened.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A structure of a slot feature for a shadow mask of a CRT in which, on an assumption that a width at a point of ½ in a vertical direction in a feature of slots for a shadow mask is 'Sw', horizontal distances from a virtual vertical straight line passing an apex of a concave portion of a slot at a marginal portion to a protrusion portion formed at both upper and lower sides on the basis of the width Sw line are 'M' and 'N', and angles having one side inclined in a direction of the protrusion portion from the virtual straight line forming a second side of the angles and passing an apex of an angular protrusion portion formed at an opposite side of the concave portion are 'P' and 'Q', there are at least one or more mask slots satisfying the following formula:

$$M>0,\ N>0,\ P>0^\circ,\ Q>0^\circ;\ \text{and}$$

wherein one side of the slot is in the form of straight lines intersecting at an angle and the opposite side is in the form of a curved line.

2. The structure of claim 1, wherein values of 'M' and 'N' of Xo on X axis are Mo and No, the values of 'P' and 'Q' are Po and Qo, and values of 'M' and 'N' of X1 on X axis are M1 and N1 and values of 'P' and 'Q' are P1 and Q1, the slots at the marginal portion satisfy the following formula:

$$\text{provided that } |X_0|<|X_1|,\ |M_0|\leqq|M_1|,\ |N_0|\leqq|N_1| \text{ and } |P_0|\leqq|P_1,\ |Q_0|\leqq|Q_1|.$$

3. The structure of claim 2, wherein the sizes of 'M', 'N', and 'Q' satisfy the following formulas:

$$0\ \text{mm}<M<0.030\ \text{mm and}$$

$$0\ \text{mm}<N<0.030\ \text{mm and}$$

$$Q<45^\circ.$$

4. The structure of claim 1, wherein values of 'M' and 'N' of Yo on Y axis are Mo and No, the values of 'P' and 'Q' are Po and Qo, and values of 'M' and 'N' of Y1 on Y axis are M1 and N1 and values of 'P' and 'Q' are P1 and Q1, the slots satisfy the following formula:

$$\text{provided that } |Y_0|<|Y_1|,\ |M_0|\geqq|M_1|,\ |N_0|\geqq|N_1| \text{ and } |P_0|\geqq|P_1|,\ |Q_0|\geqq|Q_1|.$$

5. The structure of claim 4, wherein the sizes of 'M', 'N', and 'Q' satisfy the following formulas:

$$0\ \text{mm}<M<0.030\ \text{mm and}$$

$$0\ \text{mm}<N<0.030\ \text{mm and}$$

$$Q<45^\circ.$$

6. The structure of claim 1, wherein 'D', a length of the diagonal line of an effective screen of the CRT satisfies the following formula:

$$D>490\ \text{mm}$$

7. The structure of claim 1, wherein the slots are formed to have a mutual symmetry with respect to the center of the shadow mask.

8. The structure of claim 7, wherein the symmetry is formed in a long side axis direction with respect to the center of the shadow mask.

9. A structure of a slot feature for a shadow mask of a CRT in which, on an assumption that a width at a point of ½ in a vertical direction in a feature of slots for a shadow mask is 'Sw', horizontal distances from a virtual vertical straight line passing an apex of a concave portion of a slot at a marginal portion to a protrusion portion formed at both upper and lower sides on the basis of the width Sw line are 'M' and 'N', and angles having one side inclined in a direction of the protrusion portion from the virtual straight line forming a second side of the angles and passing an apex of an angular passing an apex of an angular protrusion portion formed at an opposite side of the concave portion are 'P' and 'Q', there are at least one or more mask slots satisfying the following formula:

$$M>0,\ N>0,\ P>0^\circ,\ Q>0^\circ;\ \text{and}$$

wherein the values of M and N are selected so that the central portion of the slot is not so concave as to cause the outer side of the shape of an electron beam passing through the slot not to be straight.

10. A structure of a slot feature for a shadow mask of a CRT in which, on an assumption that a width at a point of ½ in a vertical direction in a feature of slots for a shadow mask is 'Sw', horizontal distances from a virtual vertical straight line passing an apex of a concave portion of a slot at a marginal portion to a protrusion portion formed at both upper and lower sides on the basis of the width Sw line are 'M' and 'N', and angles having one side inclined in a direction of the protrusion portion from the virtual straight line forming a second side of the angles and passing an apex of an angular protrusion portion formed at an opposite side of the concave portion are 'P' and 'Q', there are at least one or more mask slots satisfying the following formula:

$$M>0,\ N>0,\ P>0^\circ,\ Q>0^\circ;\ \text{and}$$

wherein the slot comprises two sides including the angular protrusion and the concave portion, the shapes of the sides not extending parallel to each other.

* * * * *